US011801995B1

(12) United States Patent
Glenn

(10) Patent No.: US 11,801,995 B1
(45) Date of Patent: Oct. 31, 2023

(54) TRASH CONTAINER

(71) Applicant: HOUSEHOLD ESSENTIALS, LLC, Hazelwood, MO (US)

(72) Inventor: James L. Glenn, Sunrise Beach, MO (US)

(73) Assignee: Household Essentials, LLC, Hazelwood, MO (US)

( * ) Notice: Subject to any disclaimer, the term of this patent is extended or adjusted under 35 U.S.C. 154(b) by 93 days.

(21) Appl. No.: 17/390,320

(22) Filed: Jul. 30, 2021

Related U.S. Application Data

(60) Provisional application No. 63/063,609, filed on Aug. 10, 2020.

(51) Int. Cl.
*B65F 1/00* (2006.01)

(52) U.S. Cl.
CPC ..... *B65F 1/0006* (2013.01)

(58) Field of Classification Search
CPC ..... B65F 1/0006; B65B 67/12
USPC ..... 220/23.91, 651
See application file for complete search history.

(56) References Cited

U.S. PATENT DOCUMENTS

2005/0029260 A1* 2/2005 Sheng-Bin ..... B65D 15/22 220/9.1
2006/0198562 A1* 9/2006 Mogil ..... A45C 7/0077 383/121.1
2011/0168598 A1* 7/2011 Rees ..... B65D 11/186 206/505
2012/0111860 A1* 5/2012 Colayco ..... B65D 31/04 220/6
2012/0187118 A1* 7/2012 Glenn ..... B65D 15/22 220/6
2013/0043241 A1* 2/2013 Hunter ..... B65D 19/06 220/651
2015/0344182 A1* 12/2015 Malin ..... B65D 25/04 220/528

OTHER PUBLICATIONS

Photos—https://www.householdessential.com/ecommerce/GEN-Collapsible-Laundry-Hamper.cfm?item_id=7076&parent=659&navPanel=0.

* cited by examiner

*Primary Examiner* — J. Gregory Pickett
*Assistant Examiner* — Niki M Eloshway
(74) *Attorney, Agent, or Firm* — Sandberg Phoenix & von Gontard P.C.

(57) ABSTRACT

Trash container assembly has interior container wall structure with upper edge structure, a bottom, and an upper opening and interior and exterior surfaces. The assembly has an exterior container with front, rear and side walls connected to a collapsible bottom, with the side walls connected to the front and rear walls so that the walls fold inwardly with the side walls positioned between the front and rear walls, and the bottom collapsed within the walls. In the open position the exterior container walls upper opening receives the interior container. When interior container is inserted with the exterior container, a retention member associated with the exterior container wall structure engages the interior container to resist it moving away from the exterior container. Structural supports are between side walls layers with a fold line located in between, and between front and rear wall layers, and above the bottom.

16 Claims, 3 Drawing Sheets

TRASH CONTAINER

CROSS-REFERENCE TO RELATED APPLICATIONS

This application claims the benefit of U.S. Provisional Application No. 63/063,609 filed Aug. 10, 2020, entitled TRASH CONTAINER.

STATEMENT REGARDING FEDERALLY SPONSORED RESEARCH

Not applicable.

BACKGROUND

There is a need for an environmentally appealing and functionally satisfying trash container for disposal of garbage or trash that avoids disposal of environmentally unfriendly plastic or synthetic trash bags into garbage and trash cans, bins or garbage vehicle compartments. Plastic trash bags, some with openings that can be secured at one end as by a pull strap that can be tightened or tied together, have the undesirable impact of unnecessarily disposing of plastic or other environmentally detrimental material into the waste disposal cycle. There is a need to conveniently and efficiently provide for the disposal of waste that eliminates putting a plastic or synthetic trash bag into garbage and trash cans or into other garbage disposal containers or vehicles.

The present disclosure provides an efficient and effective assembly. It comprises an exterior container configured to easily receive and hold an environmentally friendly disposable trash container such as one made of paper including a grocery shopping bag. The exterior container can be placed in an open position whereby such a grocery sack or bag can be placed within it and held in position by retaining means. The exterior container can be conveniently carried as by handles that extend above its top edge, to transport the exterior and the interior container filled with garbage or trash, to a trash disposal can, bin or dumpster. The subject exterior trash container can be conveniently folded flat and carried, transported and stored in a small and confined storage base.

DESCRIPTION OF DISCLOSURE

Figure 1:
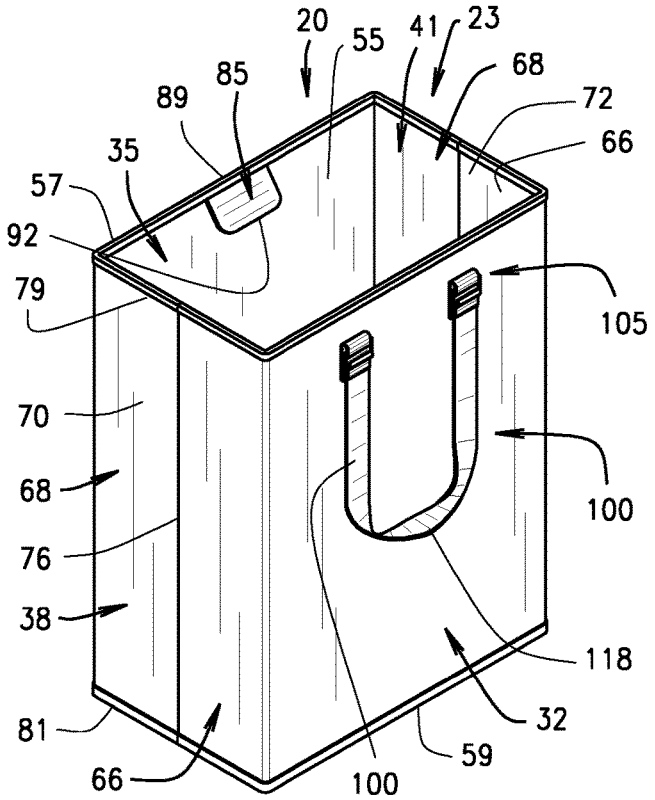
FIG. 1 is an isometric view of the exterior trash container in the open position, with the interior container not installed within the exterior container, and with the handles shown draped downwardly.

The trash container ensemble or assembly 20 generally comprises a first foldable exterior container 23 and a removable interior container 26. First, the exterior container 23 will be described in the open position such as depicted in FIGS. 1, 3-6, and 8-10. The exterior container 23 comprises a base 29 which comprises a bottom sheet 30 which can be of flexible fabric such as canvas, and of a generally rectangular configuration. The base 29 further comprises a removable bottom floor platform 31 which will be further described hereafter. The exterior container member 23 further comprises a generally vertical front wall 32, and a generally vertical rear wall 35. The exterior container 23 also comprises a generally vertical left side wall 38 and a generally vertical right side wall 41, each of which is vertically divided into two sections as will be later described.

Figure 7:
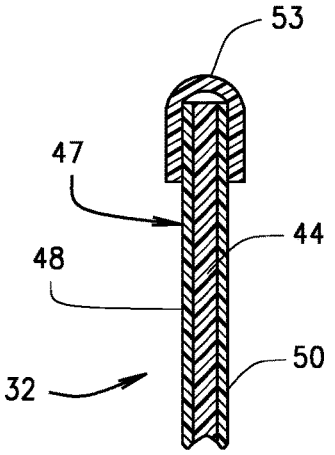
FIG. 7 is a section view taken along the line 7-7 of FIG. 3 showing the view of the front exterior container wall and its interior layer to the left, the exterior layer to the right, and the front wall panel between the two, with the welt strip secured to the inner and outer wall layers at the top.

With reference to FIG. 7, the front wall 32 comprises an interior rigid panel 44 comprised of material such as medium density fiber board ("MDF"), particle board, or plastic such as polypropylene, including fluted polypropylene. Panel 44 extends from near the top to near the bottom of the wall 32. To the interior of the front wall 32 extending from near its top to near its bottom is an interior layer 47 which can be of fabric such as canvas. Layer 47 has an inwardly facing surface 48. To the exterior of the panel 44 extending from near its top to its bottom is a front layer 50 which can be of fabric such as canvas. A strip of welt 53 extends along the upper edge of the rigid panel 44 and downward to the outside of layers 47 and 50 and is secured to layers 47 and 50 as by stitching. Similarly, at the bottom of the front wall 32 a strip of welt 54 is stitched to the lower edges of the interior layer 47 and exterior layer 50, as well as to the edge of the bottom sheet 30, so that the rigid panel 44 is held securely between the two layers 47 and 50 to be sandwiched between them in an envelope formed between layers 47 and 50 and welt strips 53 and 54. The rear wall 35 has the same sort of structure as the front wall 32 with a rigid panel like panel 44 held between an interior layer 55 and an exterior layer 56. A welt strip 57 is secured as by stitches to the upper edges of the layers 55 and 56 in the same fashion as in FIG. 7, and a welt strip 58 is likewise secured to the bottom ends of layers 55 and 56 and the adjacent edge of bottom sheet 30 to secure such rigid panel in an envelope formed between the layers 55 and 56 and welt strips 57 and 58.

Turning now to the exterior container left side wall 38 and right side wall 41, each is divided into two sections to facilitate the folding of the exterior container 23. Since the configuration of the left side wall 38 is the same as the right side wall 41, they will be described in conjunction with each other. Each side wall 38 and 41 has a first forward section 66 and a second rearward section 68. Each side near wall 38 and 41 has an exterior layer 70 and an interior layer 72, which can be of fabric such as canvas 70, and extends from near the bottom to near the top of the walls 38 and 41. The layers 70 and 72 have vertical stitching 76 extending from near their top edges to their bottom edges, to form an envelope or cavity between the layers 70 and 72 to either side of the stitching 76. The top and bottom edges of the layers 70 and 72 are secured together as by stitched welt strips 79 and 81, in the fashion such as described as to FIG. 7, to close the said envelopes at their tops and bottoms. Within each such envelope or cavity of side wall sections 66 and 68 is a rigid panel of the same material as earlier described for panel 44, that is MDF, particle board, or plastic, which extends from near the top to near the bottom of the side wall sections 66 and 68. Thus each such rigid panel is secured within the envelope or cavity formed within each forward side wall section 66 and rear wall section 68.

Figure 2:
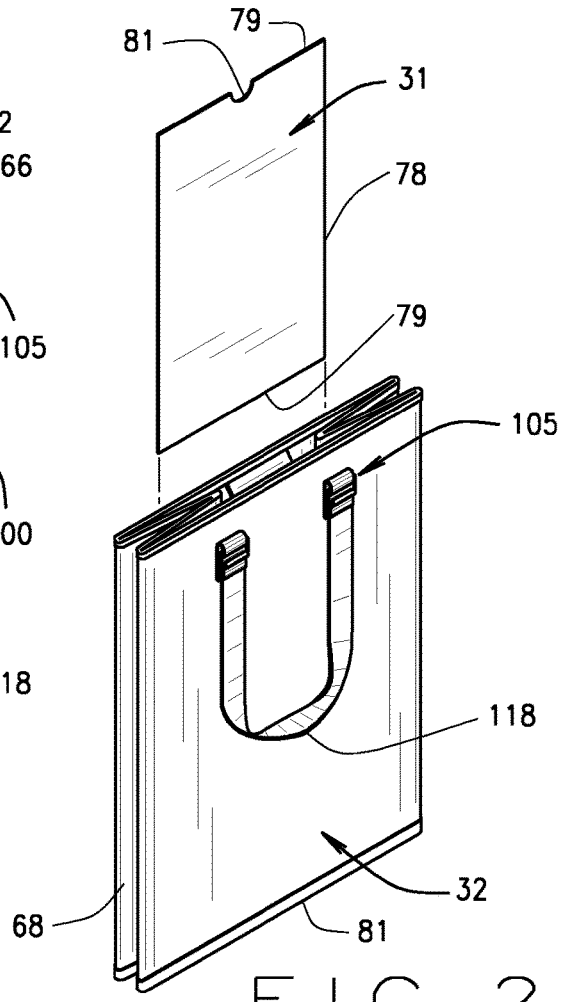
FIG. 2 is an isometric exploded view of the exterior container shown in the folded position, with the bottom platform shown exploded upwardly in line with an insertion path within the exploded container.
Figure 3:
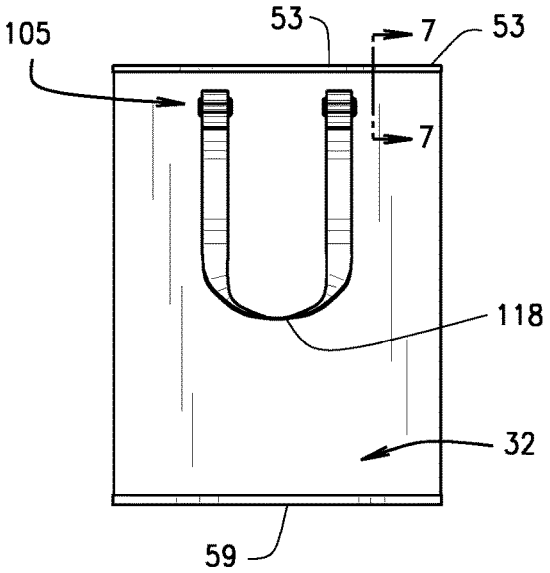
FIG. 3 is a front elevation of the exterior container of FIG. 1 in the open position.
Figure 4:
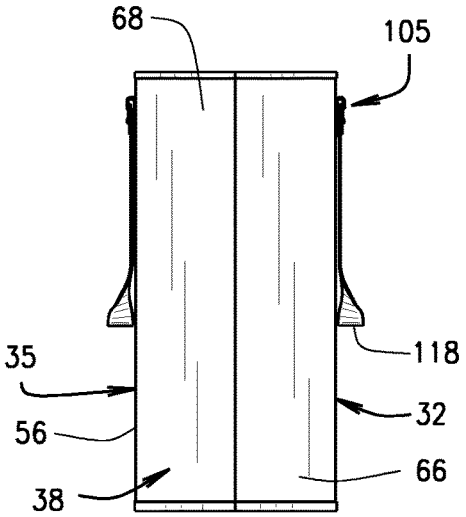
FIG. 4 is a left side elevation of the exterior container of FIG. 1 in the open position.

The side wall stitching 76 forms a vertical fold line in the side walls and allows flexing or hinging movement between each of the front and rear side wall sections 66 and 68, respectively, such as depicted in FIG. 2, to allow for the outer container 23 to fold flat, as will be later described.

Figure 5:
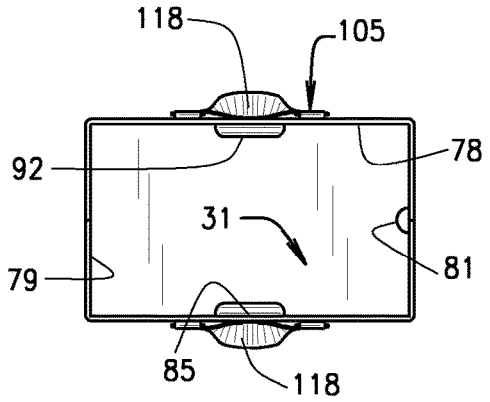
FIG. 5 is a top plan view of the exterior container of FIG. 1 in the open position.
Figure 6:
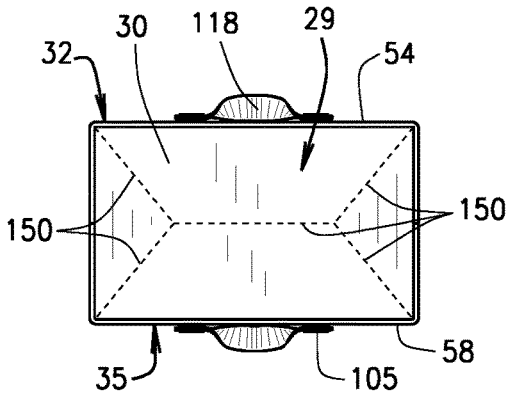
FIG. 6 is a bottom plan view of the exterior container of FIG. 1 with dashed lines showing creased lines along which the bottom sheet folds as it is moved from the open position of FIG. 1 to the folded position of FIG. 2.

As discussed earlier, the base 29 comprises bottom floor platform 31 seen in FIGS. 2 and 5. Floor platform 31 has a generally rectangular shape with a pair of longer edges 78 and pair of shorter edges 79. One of its shorter edges 79 has a semicircular notch 81. Platform 31 can preferably have a thickness of about 1/16 inch, and generally a thickness within about 1/32 inch to 1/8 inch. Its upper and lower surfaces are substantially flat. As shown in FIG. 5, when the platform 31 is installed in the open position, its longer edges 78 extend adjacent to the lower edges of the interior wall layers 47 and 55 and the shorter edges 79 extend adjacent the interior sidewall layers 72 to press outwardly against those layer to apply force to hold the exterior container 23 in the open position of FIGS. 1, 5 and 6. In that position the lower surface of floor platform 31 rests against the upper surface of the base bottom sheet 30.

At the top the exterior container 23 along the upper interior edges of each of the front walls 32 and 35, are retention members such as tabs 85. The proximal edge 89 of each tab 85 is secured as by stitching to the front and rear wall interior layers 47 and 55, respectively and to their respective welt strips 53 and 57. Each tab 85 has a distal end depicted in the drawings as a distal edge 92 that extends downwardly and is unsecured. Each tab 85 as depicted has a pair of side edges 94. The tabs 85 can be of semi-rigid material such as vinyl, leather, or 600D polyester with a polyethylene backing. The tabs 85 are preferably movable by the operator's fingers to be spaced away from the respective front and rear wall 32 and 35. Preferably the tabs have a configuration and structure to be biased for movement toward the inwardly facing surfaces 48 and 55*a* of interior layers 47 and 55, respectively. It is preferable that the tabs be connected to the interior surfaces of walls of the exterior container which inner surfaces face oppositely from each other as shown in the drawings. Thus, the tabs could be connected the interior surfaces of the side walls 38 and 41.

The exterior container 23 further comprises a pair of handles 100. Each handle 100 comprises a flexible strap 101 such as of canvas or polyester, having a pair of ends 103 shown more clearly in FIG. 11. The handles 100 can be secured to the front and rear exterior container walls 32 and 35 in various ways.

Figure 11:
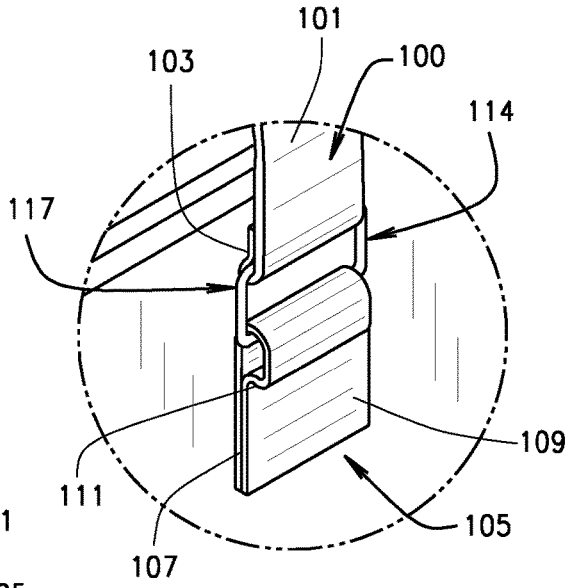
FIG. 11 is an enlarged view of the encircled area 11 of FIG. 10 showing an enlargement of mount for an end of a handle strap and showing a rectangular link extending through a loop of that handle mount, and further showing the end of a handle strap with the end folded back on itself against the strap and secured thereto, with one of the elongated ends of the link extended through that loop so that the handle can be easily moved from the downwardly extended position of FIG. 1 to the upwardly extended position of FIG. 2, through the double pivoting action of the link relative to the loop of the mount base and relative to the loop at the end of the handle strap.

A description of handle 100 secured to front wall 32 suffices to describe that for handle 100 to the rear wall 35. As shown, handle mounts 105 such as of canvas or polyester, have a strap forming a proximal base section 107 and a strap forming a distal section 109 that curls downwardly and outwardly to form a loop 111, with the lower portions of sections 107 and 109 stitched together and to the exterior front wall layer 50. A coupling link 114 can be a metal or plastic rectangular rod configuration having a pair of longer side rods and a pair of shorter end rods, with the proximal longer rod passing through the base loop 111 (FIG. 11).

The handle straps ends 103 curl inwardly and are secured as by stitches to the strap 101 to form a loop 117. The distal longer side rod of link 114 passes through the strap loop 117. The said mount loop 111 and handle strap loop 117 fit about the coupling link 114 to allow for flexible double pivotal movement of handle strap 103 relative to the mounts 105, and also to allow the straps 103 to drape downwardly alongside and in contact with the outer surfaces of walls 32 and 35 as seen in FIGS. 1, 2, 5 and 6, to make for more compact folding in the position of FIG. 2.

Figure 10:
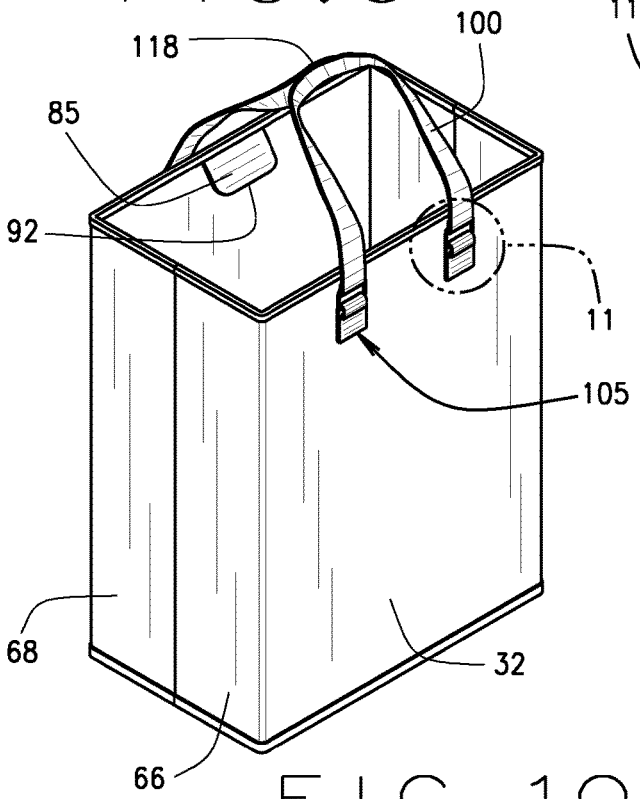
FIG. 10 is an isometric view of the exterior container in the open position, with each of the handles extended upwardly so that the bights of the handles can contact each other to permit easy grasping of both handles by the hand of an operator and with the bights of each of the handles shown in a centrally located position above the top of the walls of the exterior container.

As depicted, the handle strap 101 length is such that each handle 101 when mounted as shown has a curled bight 118 in a generally U-shaped configuration of the handle strap101 for grasping by an operator's hand. The length of the handle strap 101 should preferably be such to allow for each handle strap 103 to be extended upwardly so that each strap bight 118 extends above the central part of the exterior container, such as seen in FIG. 10, to contact each other. Preferably the vertical height of the bights 118 above the tope edges of the walls of container 23 is from about 6 1/2 inches to 9 1/2 inches. Such positioning allows a single hand of the operator to grasp around the bights 118 of both of the handle straps 103 and carry the exterior container 23 when it is in the open position of FIGS. 1, 3-6 and 8-10.

Figure 8:
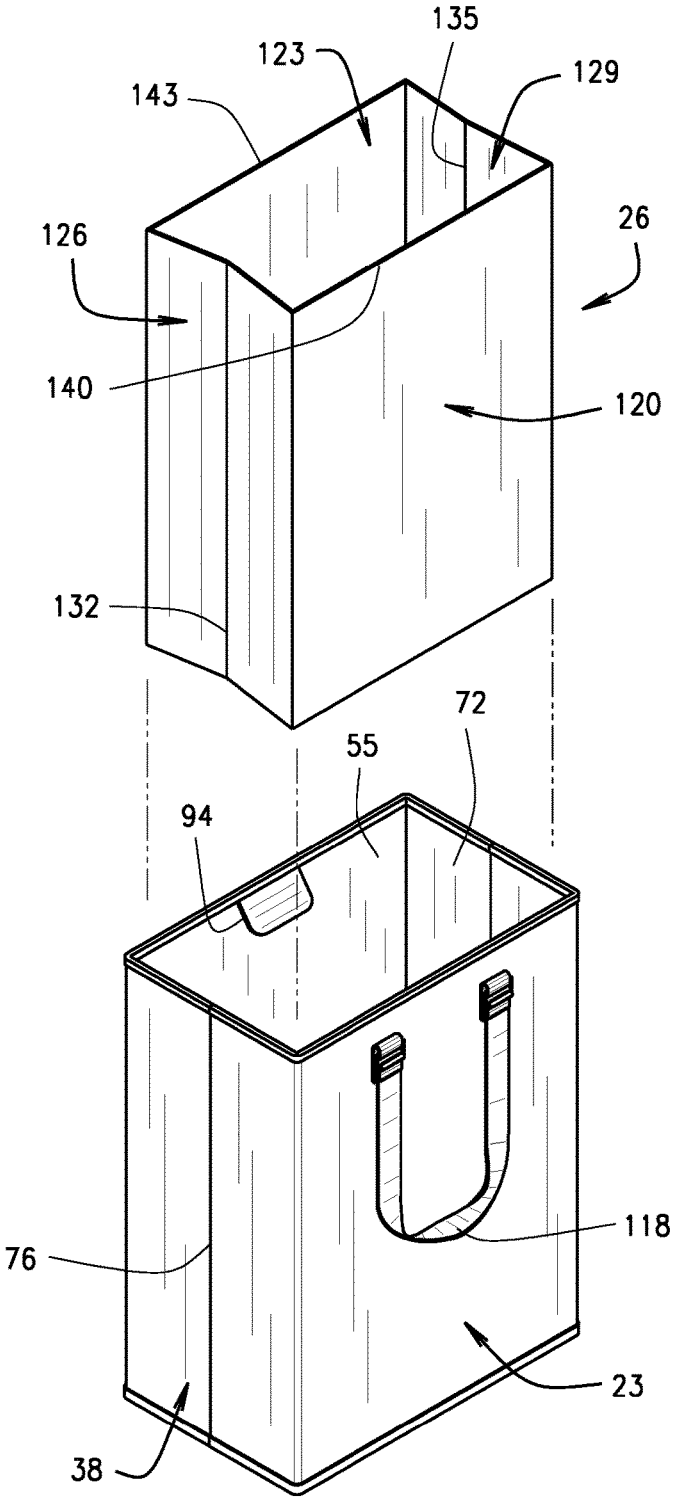
FIG. 8 is an exploded view showing at the bottom thereof the exterior container in the open position, with the interior container shown there above in the open position, and with the explosion lines showing the downwardly location of the interior container then installed within the exterior container.
Figure 9:
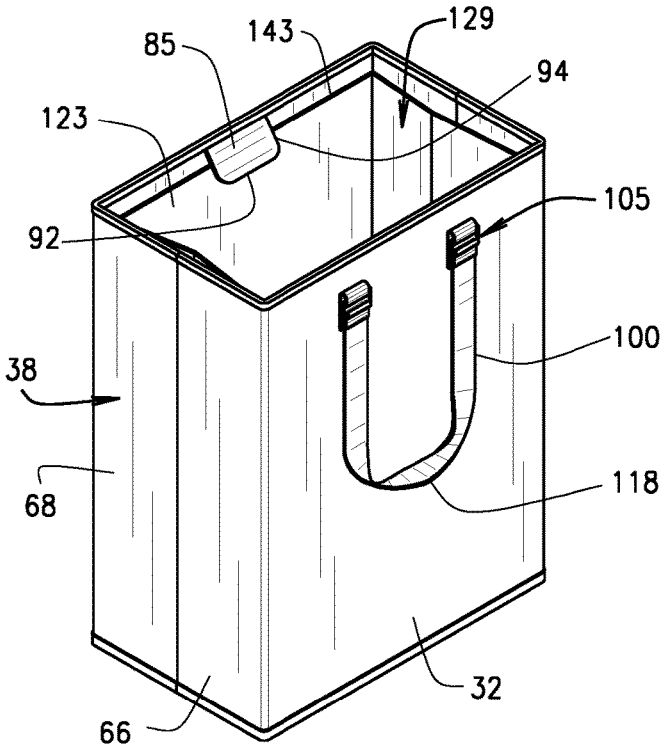
FIG. 9 is an isometric view of the trash container assembly showing the interior container in the installed position relative to the exterior container, and showing one of the exterior container retention members overlapping the top bulge of one of the sidewalls of the interior container to block inward movements to the interior container wall away from the adjacent exterior container wall to hold the interior container top in the open position to for the reception of items of trash.

Attention is now directed to the interior container 26. The interior container 26 is shown isolated in FIG. 8 positioned above the exterior container 23 within which it fits. Interior container 26 is comprised of biodegradable material such as paper or food materials. The interior container 26 preferably can have the dimensions of a standard size grocery sack composed of paper. The interior container 26 has a front wall 120 and a rear wall 123. Container 26 also has a left sidewall 126 and a right sidewall 129 the forward and rearward ends thereof being joined integrally with the front wall 120 and 123, respectively. Each of the sidewalls 126 and 129 have a crease line 132 and 135, respectively, such that container 26 can be folded and compressed. Interior container 26 has a bottom as with a standard grocery sack so that container 26 is an integrated structure in which items of trash or garbage can be placed. The dimensions of the interior container 26 are correlated to the exterior container 23 so that interior container 26 can be inserted within exterior container 23 as illustrated in FIG. 8 whereby the interior container front and rear walls 120 and 123, respectively, fit adjacent to and alongside the exterior container front wall inner surface 47 and the inner surface of rear wall 35. Likewise, the left and right interior container walls 132 and 135 fit against the interior surfaces of the left sidewall 38 and right sidewall 41 of exterior container 23. In that position the flat bottom surface of inner container 26 rests against the upper surface of the inserted floor platform 31 and above the outer container bottom sheet 30. In such position the upper edges 140 and 143 of interior containers front wall and rear wall 140 and 143 respectively fit between the respective retention tab 85 at the top of the exterior container to hold the front wall 120 and rear wall 123 of interior container 26 away from each other to easily allow trash or garbage to be inserted within the inner container 26.

When the inner container becomes filled to the degree of disposing of the trash or garbage within it, the handle straps 101 can be moved to the position shown in FIG. 10 so that a single hand of the operator can grasp about the bights 118 of handle straps 101 so the operator can lift the exterior container 23 and the interior container 26 including the items of trash or garbage contained therein. The operator can then carry the trash or garbage to a suitable disposal container, such as a can, bin, receptacle, dumpster or vehicle compartment so that the inner container 26 is also disposed along with the items of trash or garbage within it. Thus, through use of the trash container 20 items of garbage and trash can be environmentally disposed without the need to have a plastic bag or other harmful synthetic material bag disposed therewith.

The folding of the exterior container 23 from the FIG. 1 position can be accomplished with ease. First the operator's hand can be extended downwardly within the container, and a finger or thumb inserted along the platform notch 81 so that the platform 31 can be grasped between the finger and thumb and pulled upwardly to remove the platform from the interior of container 23. Then the container can be folded from front to rear so that the sidewall sections 66 and 68 fold inwardly along fold line 76 to allow compression of exterior container 23 to the position shown in FIG. 2. During the folding process the bottom base sheet 30 folds generally along the dashed straight line and diagonal dashed lines seen in FIG. 6. This allows base sheet 30 to be folded so that in the FIG. 2 folded position the base sheet 30 is folded upwardly to be within the front and rear walls 32 and the sidewalls 38 and 41. In such position the base sheet 30 does not protrude beyond the bottom edges of the front wall 32, rear wall 35 and sidewalls 38 and 41. In such folded position the floor platform 41 can be inserted downwardly such as shown in FIG. 2 to be inserted within the folded container 23. In the folded position exterior container 23 is substantially flat as seen in FIG. 2. In that position container 23 can be easily stored in narrow spaces between appliances, walls and furniture such as cabinets and in narrow spaces in vehicles such as cars and vans.

In a preferred embodiment the width of the front and rear exterior walls 32 and 35 is about 13", while the width of the left and right sidewalls 38 and 41 is about 8" with each of the sidewall sections 66 and 68 having a width of about 4", and the height of the walls 32 and 35 and of sidewalls 38 and 41 being about 17½". In such a preferred embodiment the width or depth of bottom floor platform 31 will be slightly less than the width of the front walls 32 and 35, such as about 12-¾". In such an embodiment the length of the shorter edges 79 of floor platform 81 will be slightly less than width of sidewalls 38 and 41 such as about 7-¾". The platform notch can be of the shape of a semi-circle having a diameter of about one inch, or a radius of about ½ inch. In the folded position of FIG. 2 the width of the exterior container from its outside surfaces of the front wall 32 and rear wall 35 is about ¾ inch. In the folded position of FIG. 2 the exterior container thickness from the outer surfaces of its front and rear walls is about 5/8 inch. The ratio of the thickness of the open exterior container of FIG. 1 from the outer surface of the front wall to the outer surface of its rear wall to that in the FIG. 2 folded position is about 12.8 to 1, and preferably the ratio is at least 3 to 1.

Preferably the floor platform 31 has a composition such as of polypropylene to allow for some flexibility in its bending during the process of installing and removing it from the exterior container 23.

The invention claimed is:

1. A trash container for interacting with an interior container, the interior container having a first wall with an inner surface and an upper edge and a lower part, and having a second wall with an inner surface and an upper edge and a lower part, the interior container having a bottom section connected to the lower parts of the first and second walls, the interior container configured to have an open position wherein an upper opening can be formed between the upper edges of the first and second walls, the interior container composed of biodegradable material, said trash container comprising:

a collapsible bottom member comprised of flexible material;

a first wall having a lower edge connected to the bottom member, the first wall having first and second vertical edges and an upper edge, the first wall having an inner surface and an outer surface;

a second wall having a lower edge connected to the bottom member, the second wall having first and second vertical edges and an upper edge, the second wall having an inner surface and an outer surface;

a first side wall having a first edge connected to the first edge of the first wall and a second edge connected to the first edge of the second wall, the first side wall having a lower end connected to the bottom member; the first side wall configured to fold inwardly when the first wall and second wall are moved towards each other;

a second side wall having a first edge connected to the second edge of the first wall and a second edge connected to the second edge of the second wall, the second side wall having a lower end connected to the bottom member; the second side wall configured to fold inwardly when the first wall and second wall are moved towards each other;

in an open position the first wall, second wall and side walls of the trash container are configured to be upright and extend to form an opening for the trash container sized to receive the interior container when the interior container is in an open position, with the first wall of the inner container adjacent the inner surface of the first wall of the trash container;

a retention member connected to the first trash container wall and extending therefrom to a distal end, the trash container configured so that when the interior container is received within the trash container the inner surface of the first trash container wall faces toward the first wall of the interior container with the retention member configured to engage the inner surface of the said first wall of the interior container when the interior container is inserted in the trash container to be capable of resisting the interior container from moving away from the first trash container wall with the retention member being in disengagement with the second wall of the interior container and in disengagement with the second trash container wall; and the trash container configured to have a folded position when the side walls are folded inwardly so that the side walls are between the first and second walls in the folded position, with the bottom member configured to fold to a collapsed position and capable of being maintained at least partially within the trash container walls in the folded position.

2. The trash container of claim 1 wherein the retention member is configured to be biased for movement toward the inner surface of the first trash container wall.

3. The trash container of claim 2 wherein each of the side walls have a first section and a second section, with a fold line extending from the top to the bottom of the said first and second sections, configured so that the first and second sections both can fold inwardly along said fold line, and the side walls have an exterior layer and an interior layer, with each side wall section having a structural support member interposed between the first and second layers, with the fold line located between said structural support members and with the exterior layer and interior layer connected to each other along the fold line.

4. The trash container of claim 3 wherein the structural support members are rigid panels.

5. The trash container of claim 3 wherein the first and second walls of the trash container each have an interior layer and an exterior layer with a structural support member interposed between the first and second layers of the first and second walls.

6. The trash container of claim 5 wherein the structural support members interposed between the interior and exterior layers of the first wall and second wall are rigid panels.

7. The trash container of claim 1 wherein there is a second retention member connected to the second trash container wall and extending therefrom to a distal end, the second retention member configured to engage the inner surface of the second wall of the interior container when the interior container is inserted in the trash container to be capable of resisting the interior container from moving away from the said second trash container walls.

8. The trash container of claim 1 further comprising a handle secured to the first wall and a handle secured to the second wall, each handle having a bight section and each handle having a length to extend above the tops of the first and second walls so that in the open position the bights of each handle can contact each other.

9. The trash container of claim 1 further comprising a floor platform, the platform configured to be inserted within the trash container upper opening and positioned to overlay the bottom member of the trash container.

10. A trash container ensemble assembly comprising:

a. an interior container, the interior container having a first wall with an inner surface and an upper edge and a lower part, and having a second wall with an inner surface and an upper edge and a lower part, the interior container having a bottom section connected to the lower parts of the first and second walls, the interior container configured to have an open position wherein an upper opening can be formed between the upper edges of the first and second walls, the interior container composed of biodegradable material, b. a trash container comprising:

a collapsible bottom member comprised of flexible material;

a first wall having a lower edge connected to the bottom member, the first trash container wall having first and second vertical edges and an upper edge, and an inner surface and an outer surface;

a second wall having a lower edge connected to the bottom member, the second trash container wall having first and second vertical edges and an upper edge, and an inner surface and an outer surface;

a first side wall having a first edge connected to the first edge of the first wall and a second edge connected to the first edge of the second wall, the first side wall having a lower end connected to the bottom member; the first side wall configured to fold inwardly when the first wall and second wall are moved towards each other;

a second side wall having a first edge connected to the second edge of the first wall and a second edge connected to the second edge of the second wall, the second side wall having a lower end connected to the bottom member; the second side wall configured to fold inwardly when the first wall and second wall are moved towards each other;

in an open position the trash container first wall, second wall and side walls are configured to be upright and extend to form an opening for the trash container sized to receive the interior container when the interior container is in an open position, with the first wall of the inner container adjacent the inner surface of the first wall of the trash container;

a retention member connected to the first trash container wall and extending therefrom, the trash container configured so that when the interior container is received within the trash container the inner surface of the first trash container wall faces toward the front wall of the interior container with the retention member configured to engage the inner surface of the said front wall of the interior container when the interior container is inserted in the trash container to be capable of resisting the interior container from moving away from the first trash container wall with the retention member being in disengagement with the second wall of the interior container and in disengagement with the second trash container wall; and the trash container configured to have a folded position when the side walls are folded inwardly so that the side walls are between the first and second walls in the folded position, with the bottom member configured to fold to a collapsed position and capable of being maintained at least partially within the trash container walls in the folded position.

11. The trash container of claim 10 wherein there is a second retention member connected to the second trash container wall and extending therefrom, the second retention member configured to engage the inner surface of the second wall of the interior container when the interior container is inserted in the trash container to be capable of resisting the interior container from moving away from the said second trash container wall.

12. The trash container of claim 10 wherein the retention member is configured to be biased for movement toward the inner surface of the first wall to which it is secured.

13. A trash container for interacting with an interior container, the interior container having a first wall with an inner surface and an upper edge and a lower part, and having a second wall with an inner surface and an upper edge and a lower part, the interior container having a bottom section connected to the lower parts of the first and second walls, the interior container configured to have an open position wherein an upper opening can be formed between the upper edges of the first and second walls, the interior container composed of biodegradable material, said trash container comprising:

a collapsible bottom member comprised of flexible material;

a wall having a lower edge connected to the bottom member, the first wall having first and second vertical edges and an upper edge, the first wall having an inner surface and an outer surface;

a second wall having a lower edge connected to the bottom member, the second wall having first and second vertical edges and an upper edge, the second wall having an inner surface and an outer surface;

a first side wall having a first edge connected to the first edge of the first wall and a second edge connected to the first edge of the second wall, the first side wall having a lower end connected to the bottom member; the first side wall configured to fold inwardly when the first wall and second wall are moved towards each other;

a second side wall having a first edge connected to the second edge of the first wall and a second edge connected to the second edge of the second wall, the second side wall having a lower end connected to the bottom member;

the second side wall configured to fold inwardly when the first wall and second wall are moved towards each other;

in an open position the first wall, second wall and side walls of the trash container are configured to be upright and extend to form an opening for the trash container sized to receive the interior container when the interior container is in an open position, with the first wall of the inner container adjacent the inner surface of the first wall of the trash container;

a retention member connected to the first trash container wall and extending therefrom, the trash container configured so that when the interior container is received within the trash container the inner surface of the first trash container wall faces the first wall of the interior container with the retention member configured to be biased for movement toward the inner surface of first trash container wall to which it is secured to be capable to engage the inner surface of the said first wall of the interior container when the interior container is inserted in the trash container to resist the interior container from moving away from the first trash container wall; and the trash container configured to have a folded position when the side walls are folded inwardly so that the side walls are between the first and second walls in the folded position, with the bottom member configured to fold to a collapsed position and capable of being maintained at least partially within the trash container walls in the folded position.

14. The trash container of claim 13 further comprising a second retention member connected to the second trash container wall and extending therefrom, the second retention member configured to be biased for movement toward the inner surface of second trash container wall to which it is secured to be capable to engage the inner surface of the second wall of the interior container when the interior container is inserted in the trash container to resist the interior container from moving away from the said second trash container walls.

15. A method of using a trash container ensemble assembly, the ensemble assembly comprising:

A. an interior container having a first wall with an inner surface and an upper edge and a lower part, and having a second wall with an inner surface and an upper edge and a lower part, the interior container having a bottom section connected to the lower parts of the first and second walls, the interior container configured to have an open position wherein an upper opening can be formed between the upper edges of the first and second walls, the interior container composed of biodegradable material, B. a trash container for interacting with an interior container, said trash container comprising:

a collapsible bottom member comprised of flexible material;

a wall having a lower edge connected to the bottom member, the first wall having first and second vertical edges and an upper edge, the first wall having an inner surface and an outer surface;

a second wall having a lower edge connected to the bottom member, the second wall having first and second vertical edges and an upper edge, the second wall having an inner surface and an outer surface;

a first side wall having a first edge connected to the first edge of the first wall and a second edge connected to the first edge of the second wall, the first side wall having a lower end connected to the bottom member; the first side wall configured to fold inwardly when the first wall and second wall are moved towards each other;

a second side wall having a first edge connected to the second edge of the first wall and a second edge connected to the second edge of the second wall, the second side wall having a lower end connected to the bottom member; the second side wall configured to fold inwardly when the first wall and second wall are moved towards each other;

in an open position the first wall, second wall and side walls of the trash container are configured to be upright and extend to form an opening for the trash container sized to receive the interior container when the interior container is in an open position, with the first wall of the inner container adjacent the inner surface of the first wall of the trash container; and a retention member connected to the first trash container wall and extending therefrom, the trash container configured so that when the interior container is received within the trash container the inner surface of the first trash container wall faces the first wall of the interior container with the retention member configured to be capable to engage the inner surface of the said first wall of the interior container when the interior container is inserted in the trash container to resist the interior container from moving away from the first trash container wall;

C. the method steps comprising:

the trash container being place in the said open position with its opening formed;

the trash container receiving the interior container, with the first interior container wall being positioned inside of and adjacent to the first wall of the trash container, and with the second interior container wall inside of and adjacent to the second wall of the trash container; and the retention member receiving the inner surface of the first container wall with the upper edge and part of the inner surface of the first wall of the interior container positioned for the retention member to at least be partially to the inside of the said inner surface of the first interior container wall to engage the first interior container wall to resist the first interior container wall from moving away from the first trash container wall.

16. The method of claim 15 wherein:

the trash container is configured to have a folded position when the side walls are folded inwardly so that the side walls are between the first and second walls in the folded position, with the bottom member configured to fold to a collapsed position and capable of being maintained at least partially within the trash container walls in the folded position;

wherein the method further comprises folding the trash container side walls inwardly so that the side walls are between the first and second trash container walls in a folded position, and folding the bottom member to a collapsed position to be at least partially within the trash container walls.

* * * * *